US011602193B2

(12) United States Patent
Lacroix et al.

(10) Patent No.: US 11,602,193 B2
(45) Date of Patent: Mar. 14, 2023

(54) SAFETY FOOTWEAR

(71) Applicant: L.P. ROYER INC., Lac-Drolet (CA)

(72) Inventors: Francis Lacroix, Lac-Drolet (CA); Simon La Rochelle, Lac-Drolet (CA)

(73) Assignee: L.P. ROYER INC., Lac-Drolet (CA)

( * ) Notice: Subject to any disclaimer, the term of this patent is extended or adjusted under 35 U.S.C. 154(b) by 129 days.

(21) Appl. No.: 15/287,046

(22) Filed: Oct. 6, 2016

(65) Prior Publication Data

US 2017/0095032 A1 Apr. 6, 2017

Related U.S. Application Data

(60) Provisional application No. 62/237,704, filed on Oct. 6, 2015.

(51) Int. Cl.

| | |
|---|---|
| ***A43B 7/32*** | (2006.01) |
| ***A43B 23/08*** | (2006.01) |
| ***A43B 13/10*** | (2006.01) |
| ***A43B 13/14*** | (2006.01) |
| ***A43B 3/02*** | (2006.01) |
| ***A43B 5/00*** | (2022.01) |
| ***A43B 13/04*** | (2006.01) |
| ***A43B 13/12*** | (2006.01) |
| ***A43B 13/22*** | (2006.01) |

(52) U.S. Cl.

CPC ..... *A43B 7/32* (2013.01); *A43B 3/02* (2013.01); *A43B 5/002* (2013.01); *A43B 13/04* (2013.01); *A43B 13/10* (2013.01); *A43B 13/122* (2013.01); *A43B 13/125* (2013.01); *A43B 13/14* (2013.01); *A43B 13/141* (2013.01); *A43B 13/223* (2013.01); *A43B 23/081* (2013.01)

(58) Field of Classification Search

CPC ..... A43B 7/32; A43B 13/42; A43B 23/081
USPC ..... 36/96, 77 R
See application file for complete search history.

(56) References Cited

U.S. PATENT DOCUMENTS

| | | | | | |
|---|---|---|---|---|---|
| 1,221,985 | A * | 4/1917 | Golden | A43B 5/02 | 36/107 |
| 2,486,953 | A * | 11/1949 | Keene | A43B 23/082 | 36/4 |
| 3,444,572 | A * | 5/1969 | Broughton | A43B 7/32 | 12/142 E |
| 4,839,971 | A * | 6/1989 | Reber | A43B 23/087 | 36/72 R |

(Continued)

*Primary Examiner* — Sharon M Prange
(74) *Attorney, Agent, or Firm* — Norton Rose Fulbright Canada LLP

(57) ABSTRACT

An item of footwear comprises an upper adapted to receive a foot of the wearer and having a front-end portion. An outsole forms a bottom surface of the item of footwear, the outsole being single-piece monolithic and having a concave outsole shell receiving in its outsole concavity at least part of the front-end portion. A midsole being single-piece monolithic may be in direct-attach connection between the upper and the outsole, the midsole having a concave midsole shell between the concave outsole shell and the front-end portion, the concave midsole shell receiving in its midsole concavity at least part of the front-end portion. A shock-absorbing pad may be between the concave shell and the front-end portion of the upper, the shock-absorbing pad being made of a material attenuating an impact force by at least 60% in a flat surface impact test, single drop of a 8.5 kg mass, at 1.0 m/s velocity.

4 Claims, 7 Drawing Sheets

(56) References Cited

U.S. PATENT DOCUMENTS

| | | | | | |
|---|---|---|---|---|---|
| 4,924,606 | A * | 5/1990 | Montgomery | A43B 3/30 | 36/102 |
| 5,035,069 | A * | 7/1991 | Minden | A43B 5/12 | 36/113 |
| 5,946,755 | A * | 9/1999 | Aoki | A43B 7/32 | 12/142 RS |
| 6,041,520 | A * | 3/2000 | Aoki | A43B 7/32 | 36/14 |
| 6,631,569 | B1 * | 10/2003 | Scharbius | A43B 7/32 | 36/72 R |
| 6,880,268 | B2 * | 4/2005 | Chen | A41B 11/007 | 36/10 |
| 7,234,251 | B2 * | 6/2007 | Fuerst | A43B 1/0027 | 36/11.5 |
| 7,290,356 | B2 * | 11/2007 | Fuerst | A43B 1/0027 | 36/102 |
| 7,441,351 | B2 * | 10/2008 | Clark | A43B 1/0045 | 36/113 |
| 7,631,440 | B2 * | 12/2009 | Keen | A43B 1/14 | 36/50.1 |
| 7,762,012 | B2 * | 7/2010 | Fuerst | A43B 1/0027 | 36/102 |
| 8,359,772 | B2 * | 1/2013 | La Rochelle | A43B 9/00 | 12/142 K |
| 8,898,933 | B2 * | 12/2014 | Sakurai | A43B 7/32 | 36/114 |
| 2010/0236098 | A1 * | 9/2010 | Morgan | A43B 7/144 | 36/91 |
| 2014/0223773 | A1 * | 8/2014 | Burman | A43B 23/081 | 36/87 |

* cited by examiner

SAFETY FOOTWEAR

CROSS-REFERENCE TO RELATED APPLICATION

The present application claims the priority of U.S. Patent Application Ser. No 62/237,704, filed on Oct. 6, 2015.

FIELD OF THE APPLICATION

The present application relates to footwear and, more specifically, to safety footwear of the type used to protect the feet of a user, for example in the construction industry, in warehouses, in manufactures, etc.

BACKGROUND OF THE ART

Safety footwear is often required as protective equipment, when a wearer is exposed to impacts, for example in the construction industry, in warehouses, in manufactures, etc. A primary function of safety footwear, such as safety boots or shoes, is to protect the foot against impacts. Accordingly, some items of footwear include a toe-cap (e.g., steel toe or composite toe). The toe-cap is a shell defining a volume accommodating the toes of the wearer in the item of footwear, the shell being of rigid and impact-proof material protecting the toes against the impact from objects falling against the footwear. In most safety footwear, the toe-cap is within the upper and is therefore under the leather or synthetic material forming the exposed surface of the upper. As the material of the upper is above that of the toe-caps, the material of the upper often rips or is damaged over time as a result of abrasion and impact, thereby exposing the toe-cap material. Indeed, as they are even used as "hammers" to kick objects, safety boots with toe-caps often wear out prematurely in the toe region.

The premature wearing-out of the leather in the toe region, accentuated by the presence of toe-caps, resulted in shoe manufacturers adding a protective shell over the leather in the toe region. Such a protective shell, commonly referred to as "bumper toe", is made of a resistant compound (e.g., polyurethane). By protecting the material of the upper where the upper would normally break and tear, protective shells enhance the durability of the item of footwear.

Some bumper toes are cemented to the uppers prior to the soling process and a portion of such bumper toes is folded and secured under the edge of the last. Some bumper toes are molded during the molding of a midsole in a direct-attach construction, for example by injection molding or pouring.

Therefore, there remains a weakness at the junction between the bumper toe and the sole, as well as between the midsole and outsole in a dual density construction, in the front-end region of the item of footwear. The front-end region is subject to abrasion and/or intense shocks, which may result in the premature wear of the item of footwear.

SUMMARY OF THE APPLICATION

It is therefore an aim of the present invention to provide safety footwear that addresses issues related to the prior art.

Therefore, in accordance with the present application, there is provided an item of footwear comprising: an upper adapted to receive a foot of the wearer and having a front-end portion; an outsole forming a bottom surface of the item of footwear, the outsole being single-piece monolithic and having a concave outsole shell receiving in its outsole concavity at least part of the front-end portion; and a midsole being single-piece monolithic and being in direct-attach connection between the upper and the outsole, the midsole having a concave midsole shell between the concave outsole shell and the front-end portion, the concave midsole shell receiving in its midsole concavity at least part of the front-end portion.

In accordance with another embodiment, there is provided an item of footwear comprising: an upper adapted to receive a foot of the wearer and having a front-end portion; a sole forming a bottom surface of the item of footwear, a concave shell receiving in its concavity at least part of the front-end portion of the upper; and a shock-absorbing pad between the concave shell and the front-end portion of the upper, the shock-absorbing pad being made of a material attenuating an impact force by at least 60% in a flat surface impact test, single drop of a 8.5 kg mass, at 1.0 m/s velocity.

DESCRIPTION OF THE PREFERRED EMBODIMENTS

Figure 1:
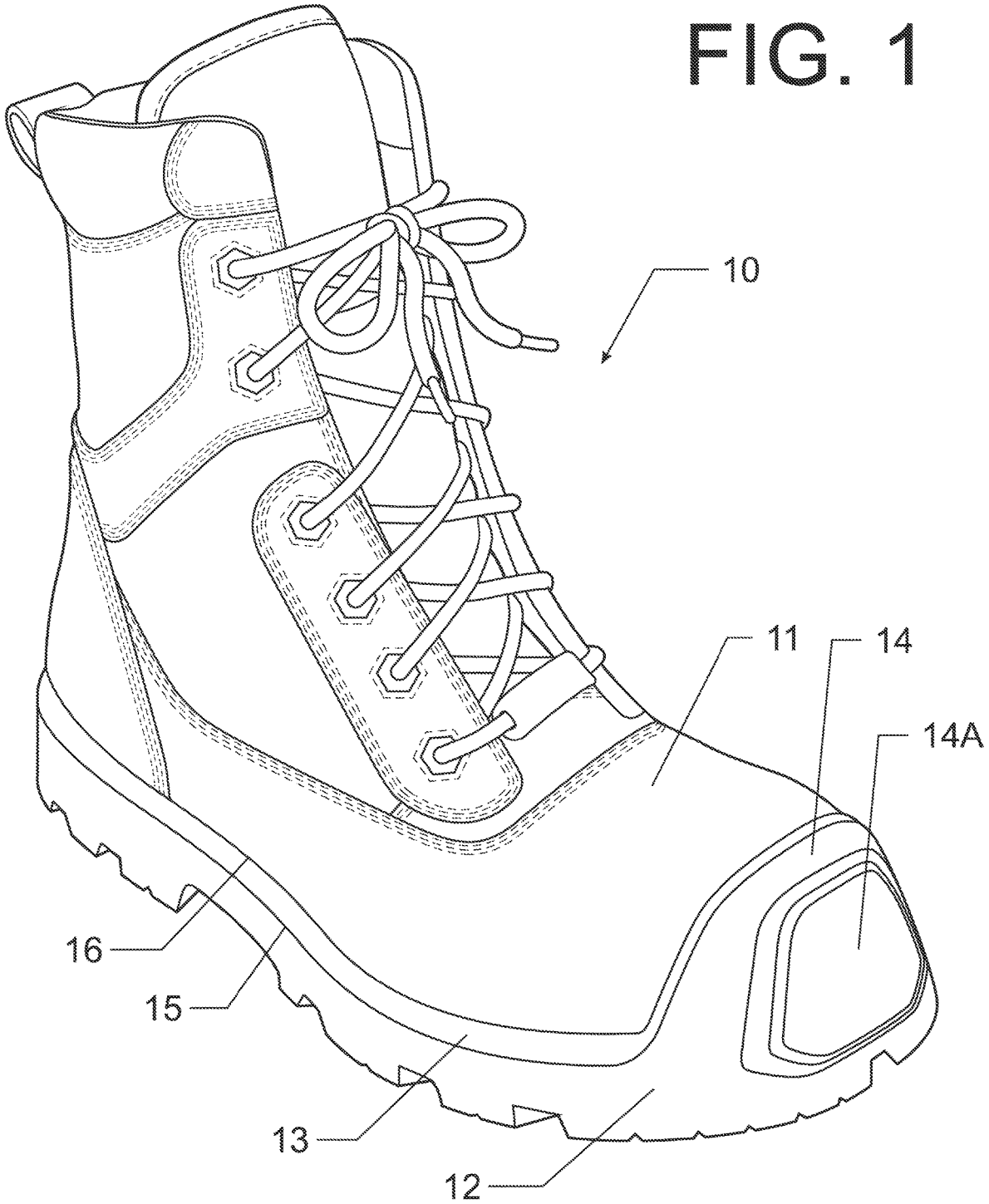
FIG. 1 is a perspective view of an item of footwear in accordance with the present disclosure.

Referring to the drawings, and more particularly to FIG. 1, a boot in accordance with the present disclosure is generally shown at 10. The item of footwear 10 is illustrated as a boot, but could also be a shoe or any type of footwear featuring a protective shell as described hereinafter. Moreover, the boot 10 is shown with laces. However, it is understood that the boot 10 may comprise any suitable attachment means such as Velcro®, elastics, straps or the like during normal use. Although the expression "boot" is used, the item of footwear 10 may be known as a work boot, construction boot, hiking boot among other possible nomenclatures.

The boot 10 has an upper 11 that constitutes the top portion of the boot 10. The upper 11 therefore covers a top portion and sides of the foot and, in some cases, a portion of the ankle and shin. For simplicity, other known components such as the tongue, and eyelets, as well as decorative or structural parts of the upper 11 are illustrated but not detailed. The upper 11 may be made from a natural or synthetic leather, different polymers and composites, among numerous other possible materials or combinations of material.

The boot 10 further comprises a sole, for instance constituted of an outsole 12 and a midsole 13. The sole is the interface of the boot with the ground and its footprint may have any appropriate patterns or lugs to provide friction and/or purchase to the wearer. In the illustrated embodiment, the midsole 13 joins the outsole 12 to the upper 11. As observed in FIG. 1, the sole has a portion projecting from an upper surface of its foot-facing side and extending upwardly at a front portion of the boot 10 and forms a concave sole shell 14 encapsulating a front portion of the boot 10. The concave sole shell 14 is illustrated as being monolithically part of the sole, as observed from the lines showing that both the outsole 12 and the midsole 13 may be part of the concave sole shell 14. The figures illustrate that the concave sole shell 14 may have a portion that is seamlessly part of the outsole 12, and another portion that is seamlessly part of the midsole 13, as a result of a molding of the outsole 12 as a single piece, and the subsequent direct-attach injection of the midsole 13 between the upper 11 and the outsole 12, such that the concave sole shell 14 encapsulates a front portion of the upper 11. Hence, the sole 12/13 is overmolded or molded by direct injection with the concave sole shell 14 onto the upper 11, to use other expressions describing the direct-attach molding, according to an embodiment. Other manufacturing processes are contemplated, such as stitching, gluing, cementing, etc, in accordance with other methods. The direct-attach process may be in numerous steps, including the molding of the outsole 12, the positioning of the upper 11 and the outsole 12 in a mold, with a space between, and the subsequent injection of the midsole 13 in the space between the upper 11 and the outsole 12. This may require some forms of automation or manipulations, and adapted tooling, considering that the upper 11 must be inserted in the outsole component of the concave sole shell 14, prior to the injection of the midsole 13 to direct-attach the upper 11, the outsole 12 and the midsole 13.

In the direct-attach process, the outsole 12 may be made of a rubber or other polymers, with different properties, such as tear resistance, corrosion resistance, flexing endurance, adherence, etc. The midsole 13, on the other hand, is made of a polymer such as polyurethane, which is known to form a permanent bond to given materials it interconnects. Polyurethane also provides the benefits of lightness, flexibility and waterproofness to the item of footwear. In the present embodiment, the polyurethane or equivalent of the midsole 13 bonds the upper 11 to the outsole 12. The midsole 13 may also provide some cushioning effect by having greater compliance than the outsole 12. The junction between the upper 11 and the sole is delineated by the junction lines 15 and 16. The junction line 15 is between the outsole 12 and the midsole 13, whereas the junction line 16 is between the midsole 13 and the upper 11. In the illustrated embodiment, there is no seam line in the sole, other than the junction 15 between the outsole 12 and the midsole 13, due to the monolithic construction of the outsole 12 (with its concave cap portion) and due to the monolithic construction of the midsole 13 (with its concave cap portion). Stated differently, the outsole 12 is a single piece resulting from its manufacturing (molding or heat-pressing), and does not have any adhesive between two distinct parts manufactured separately. Likewise, the midsole 13 is a single integrally-formed piece resulting from the direct-attach injection process. As other embodiments, the soles 12/13 may be cemented, vulcanized or stitched.

Figure 3:
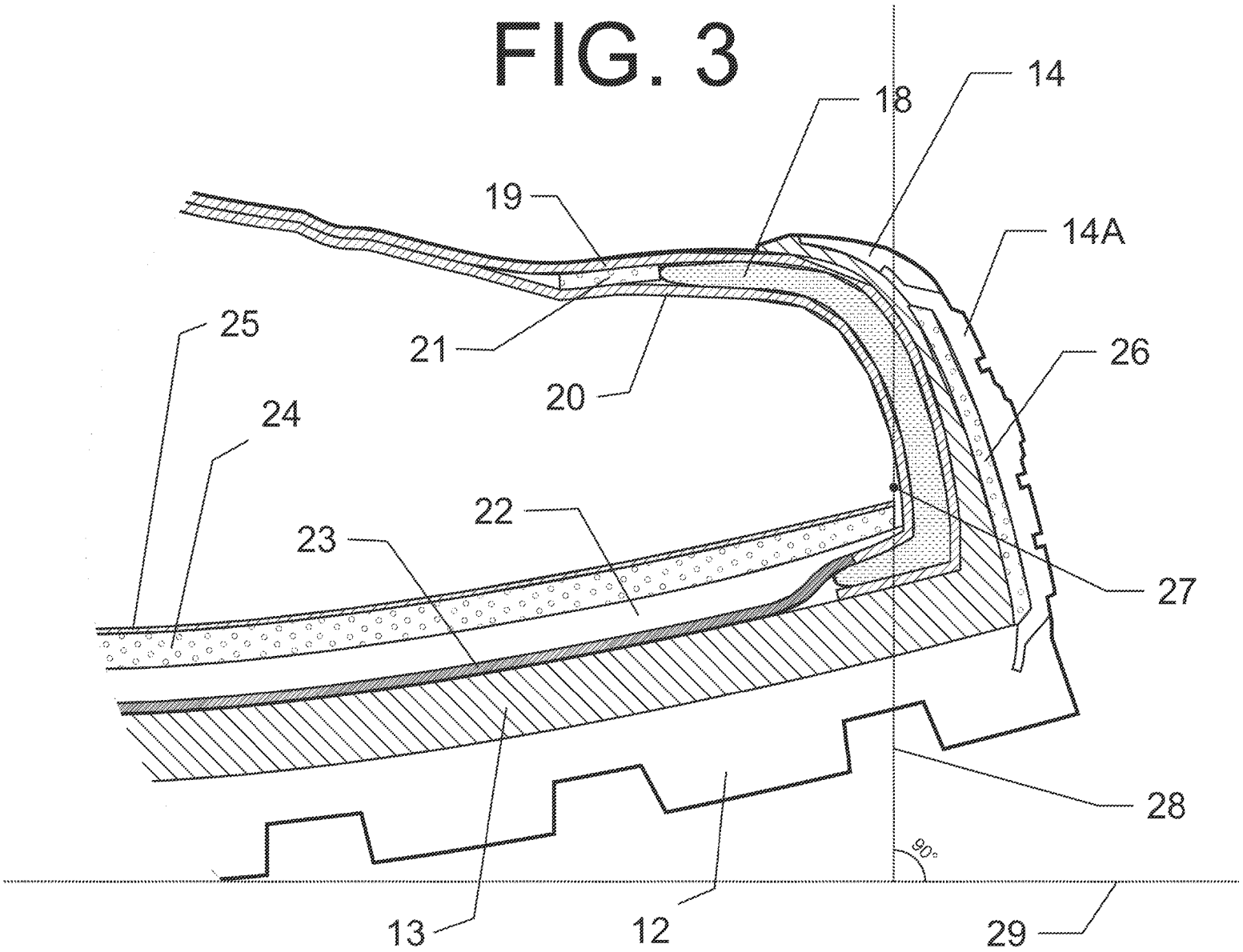
FIG. 3 is an enlarged section view of a front portion of the item of footwear of FIG. 1, in accordance with a first embodiment.

The concave sole shell 14 may incorporate a bumper toe plate 14A (a.k.a., head plate) exposed through an opening at its front end. The bumper toe plate 14A may be made of a rigid material in contrast to the rubbery material of the sole forming the concave sole shell 14. For example, the bumper toe plate 14A may be constituted of a metal or hard plastic, with low compliance, and high hardness, in contrast to the material(s) of the sole. The bumper toe plate 14A may therefore be used for impacting items. For example, the bumper toe plate 14A may be used to hammer a nail by a kicking action of the wearer of the boot 10. Referring to FIG. 3, the periphery of the bumper toe plate 14A may be sandwiched between the outsole 12 and midsole 13, so as to be secured to a front end of the item of footwear 10, with a peripheral portion of the outsole 12 overlapping and covering a peripheral portion of the bumper toe plate 14A. Adhesives may be used to enhance the connection between the bumper toe plate 14A and the sole.

Figure 2:
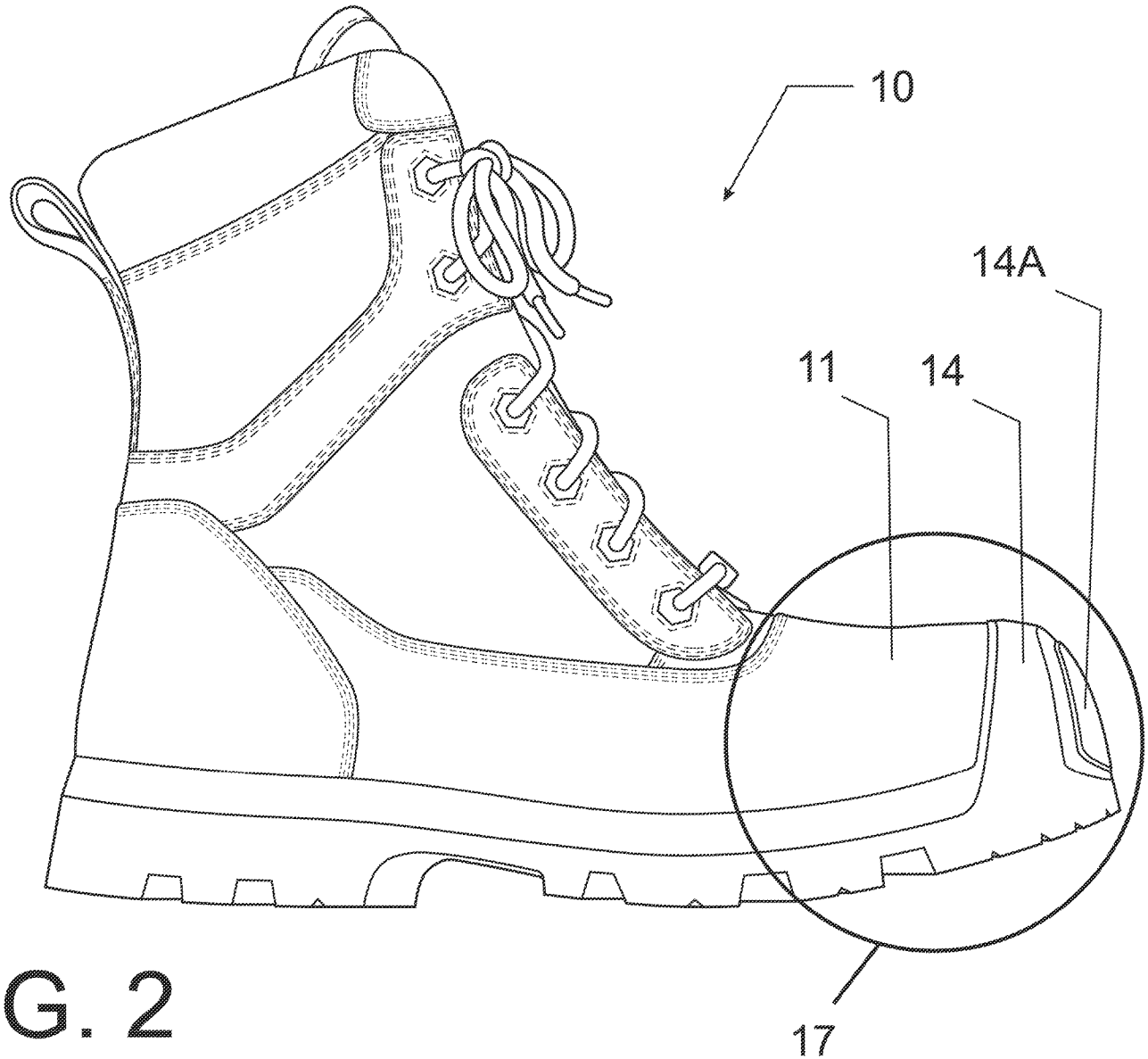
FIG. 2 is a side view of the item of footwear of FIG. 1.

Referring to FIG. 3, a sectional view illustrates the various components of the item of footwear 10, in accordance with a first exemplary embodiment, as zoomed in and sectioned from the window 17 of FIG. 2. A protective toe-cap 18 is covered by the material of the upper 11 (FIGS. 1 and 2) and that of the concave sole shell 14 of the sole. The protective toe-cap 18 is a shell made of a hard material to cover the wearer's toes and protect them from impacts. The upper may be constituted of different layers, including an outer layer 19. The upper may also comprise a lining layer 20 forming the inner surface of the boot 10. A strip 21 may be at the end of the protective toe-cap 18 so as to form a smooth transition between the different components of the upper.

At its interface with the bottom of the foot, the boot 10 may have different layers including an insole board 22 lying on top of a textile layer 23 that covers the midsole 13. A removable sock liner 24 may cover the insole board 20 for hygienic reasons. The removable sock liner 24 may provide some resilience and padding for the foot, the sock liner 24 being, for example, the most compliant part of the underside of the boot 10. The sock liner 24 may be a composite of laminated layers and may include a textile or fabric 25 thereon. As the bumper toe plate 14A is rigid, it is contemplated to insert a shock absorbing pad 26 between the bumper toe plate 14A and the portion of the midsole 13 that is part of the concave sole shell 14. As shown in FIG. 3, the shock absorbing pad 26 is sandwiched between the bumper toe plate 14A and the midsole 13. Different materials may be used for the shock absorbing pad 26, including polyurethane foams, butyl rubber foam, neoprene foam, etc. It is targeted to use foam materials with specific viscoelastic properties whose molecular structure crystallizes as a result of rapid deformation caused by potential energy absorption in the form of heat. This property can be found in a wide range of commercial products such as, but not limited to some polyurethane foams, e.g., Poron®, D3O®, or in the class of polyisobutylene rubbers. For example, a non-exhaustive list includes ester polyurethane, ether polyurethane, foamed polyurethane, viscoeslastic foam, polyurethane memory foam, polyethylene foam, blended EVA foam, molded silicone rubber, butyl rubber, fluoro rubber sponge, and urethane-based synthetic shock absorbing gel.

The shock attenuation resulting from the use of such viscoelastic foam materials and rate dependent compression materials, at least some of which may be known as memory foams, can be described as an absorption of at least 60% of impacts, when tested according to ASTM F1614-C. This implies that the pad 26 be capable of attenuating impact forces by at least 60%, when tested by a method covering the measurement of certain shock attenuating characteristics, rapid rate force-displacement relationships, of materials systems employed in the midsole of athletic footwear intended for use in normal running movements. This test method may cover different procedures for performance of the rapid rate force application: Procedure A for falling weight impact machines, Procedure B for compression force controlled machines, and Procedure C for compression displacement controlled machines. The material system response for rapid rate force application may be different for each of the three procedures of this test method. The test method is empirically based on the use of an 8.5-kg mass dropped from 50 mm (1.97 in.) to generate peak compressive forces which are comparable to that experienced by a midsole in heel strike tests for normal running movement. According to another testing method, the pad 26 is capable of attenuating impact forces by at least 60% in a flat surface impact test, single drop of a 8.5 kg mass, at 1.0 m/s velocity.

This requires the specimen to be rigidly supported and the energy to be delivered through a 45-mm (1.8-in.) diameter flat up. The test method imposes an impulse to generate a rapid rate compressive force-displacement hysteresis cycle and evaluates shock attenuating characteristics of the specimen. The maximum energy applied to the specimen occurs at peak displacement and must be within 10% of a reference value that is used to normalize the data for comparative purposes.

Their relative density may be between 0.24 and 1.0 g/cm$^3$. The Shore "A" hardness may be between 30 and 60. The shock absorbing pad 26 may have a greater compliance than the rigid bumper toe plate 14A and greater than the outsole 12 and midsole 13, and may therefore reduce energy transferred to the foot, ankle, knee hip and back of the wearer upon impact against the front end of the item of footwear 10. The pad 26 is particularly advantageous considering the presence of the protective toe-cap shell 18 lying under the midsole 13 and offering little compliance. Accordingly, an impact on the bumper toe plate 14A or front end of the item of footwear 10 may cause deformation of the shock absorbing pad 26 and therefore energy dissipation.

Still referring to FIG. 3, a foremost point of the concave surface of the protective toe-cap 18 is illustrated at 27. The concave sole shell 14 of the sole 12 therefore extends above the foremost point 27 along vertical axis 28, and extends rearwardly of the foremost point 27 along horizontal axis 29, in forming its concavity.

Figure 4:
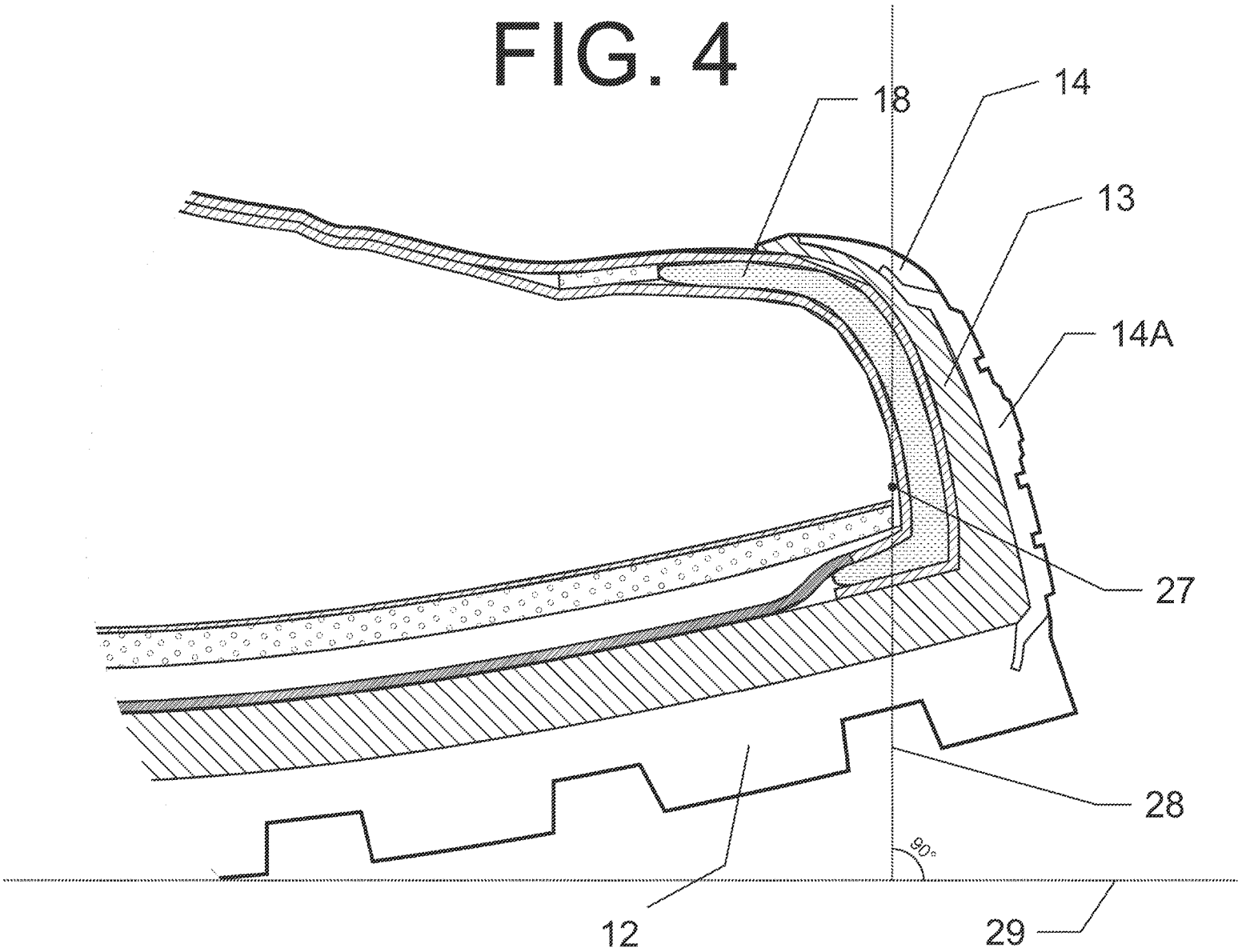
FIG. 4 is an enlarged section view of a front portion of the item of footwear of FIG. 1, in accordance with a second embodiment.

Referring to FIG. 4, another embodiment is shown, in which the shock absorbing pad 26 is absent. In such an embodiment, it is the material of midsole 13 that acts as a shock absorber. As the midsole 13 is made of an elastomeric material, and is sandwiched between two rigid materials (i.e., the bumper toe portion 14A and the protective toe-cap shell 18) of lower compliance, the midsole 13 may deform to dissipate shock energy.

Figure 5:
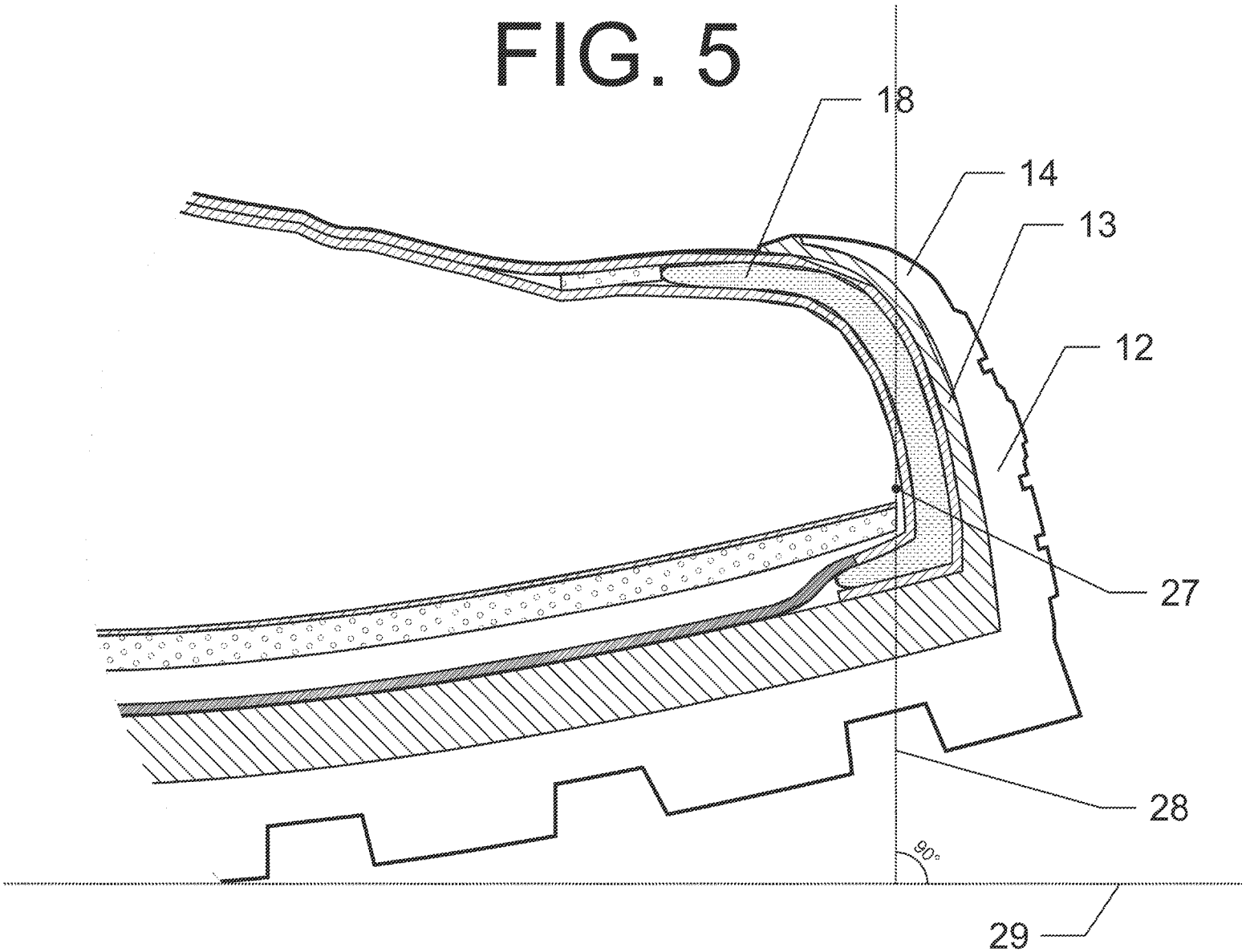
FIG. 5 is an enlarged section view of a front portion of the item of footwear, in accordance with a third embodiment.

Referring to FIG. 5, yet another exemplary embodiment is illustrated, in which there is no bumper toe plate 14A and no shock absorbing pad 26. FIG. 5 illustrates that the sole, including the outsole 12 and the midsole 13, has its material extend over the front toe portion of the upper 11 so as to form the concave sole shell 14 encapsulating a portion of the protective toe cap 18. It is considered to provide a lower density to the midsole 13 in the front toe portion to act as shock absorbing pad.

Figure 6:
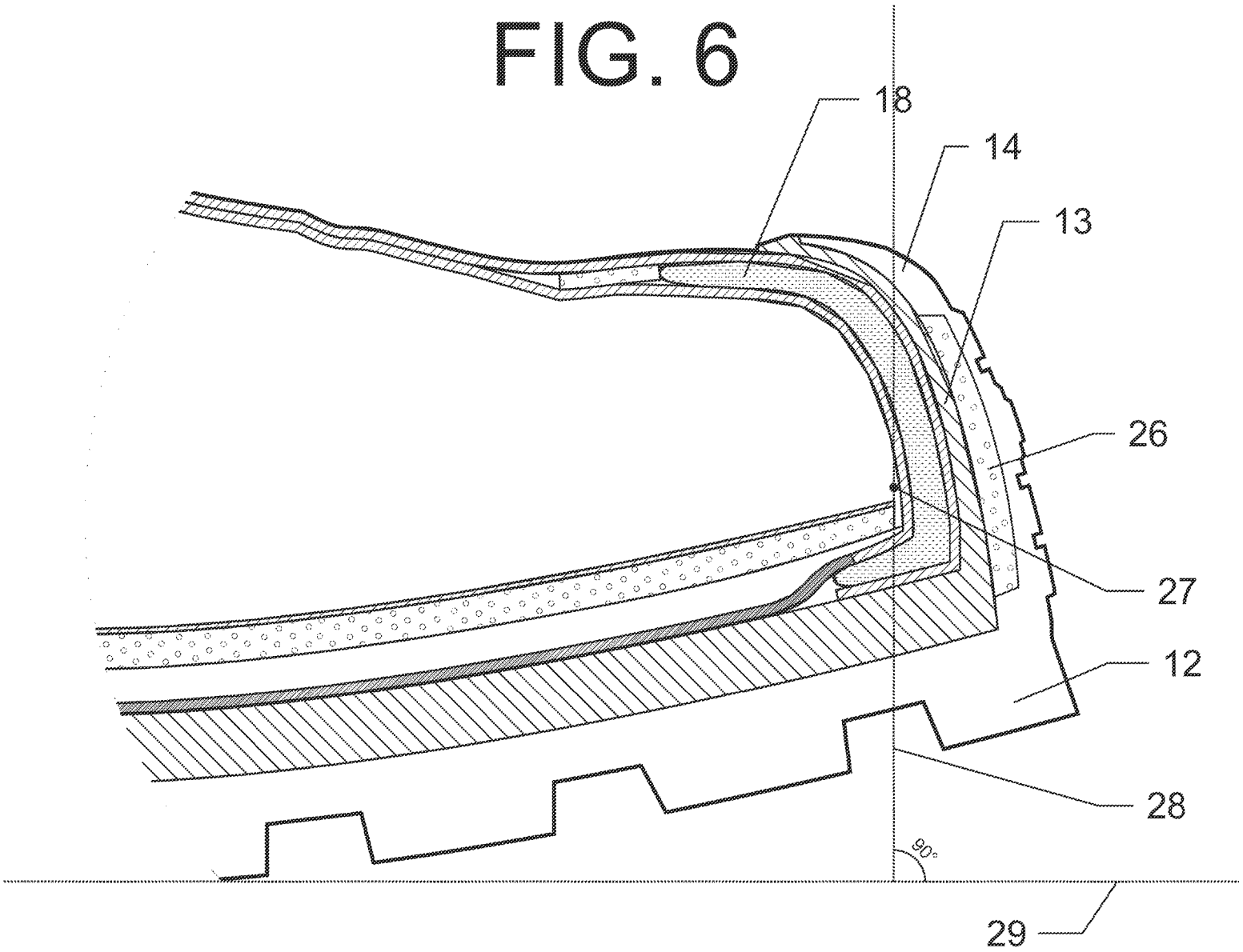
FIG. 6 is an enlarged section view of a front portion of the item of footwear, in accordance with a fourth embodiment.

As shown in FIG. 6, the item of footwear is without bumper toe plate 14A, but includes a shock absorbing pad 26 to dissipate any energy from impact at the front of the boot 10. The shock absorbing pad 26 is received in a cavity of the outsole portion of the concave sole shell 14, and is sandwiched between the outsole 12 and the midsole 13. Accordingly, the arrangement of FIG. 6 may be achieved by the direct-attach process or by cementing, with the shock absorbing pad 26 being an insert.

Figure 7:
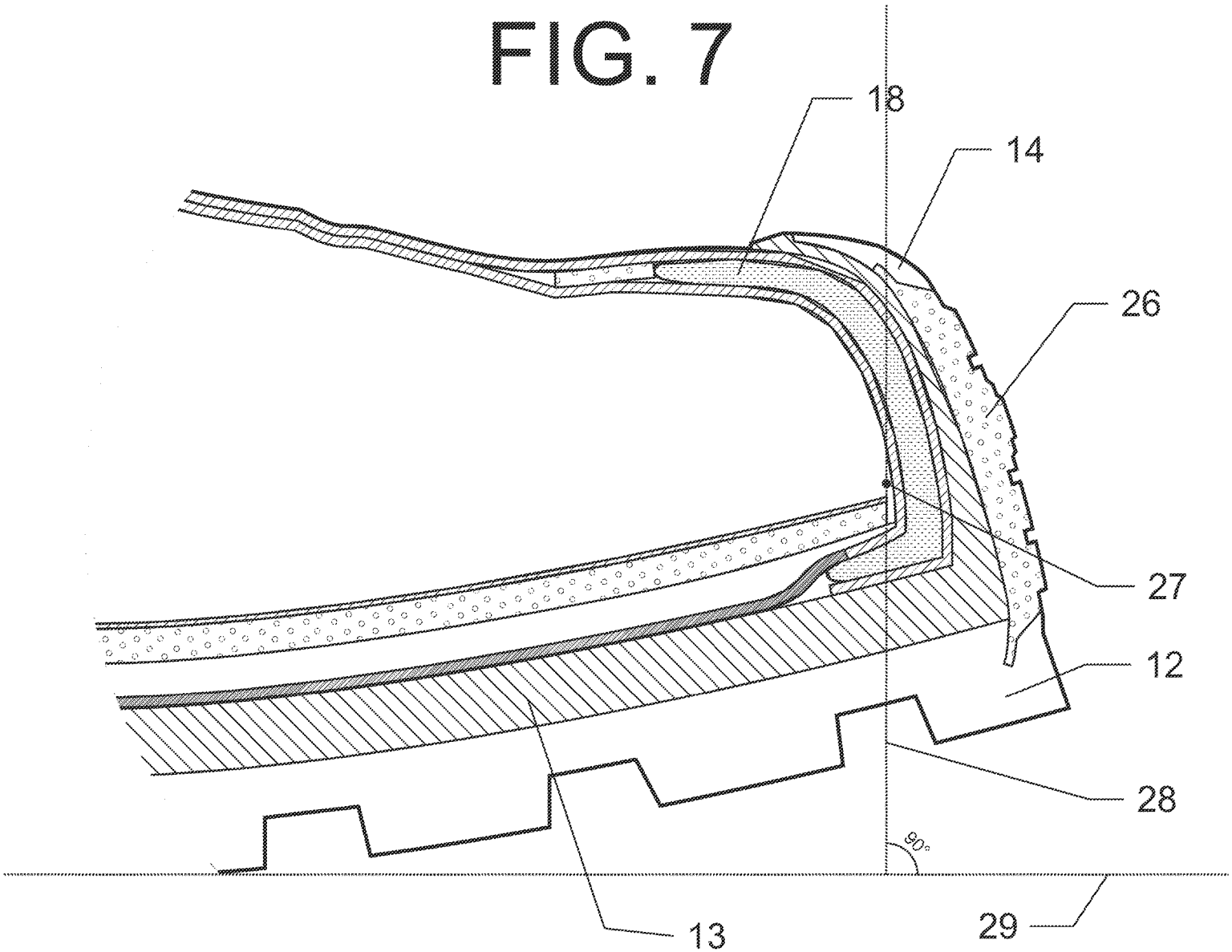
FIG. 7 is an enlarged section view of a front portion of the item of footwear of FIG. 1, in accordance with a fifth embodiment.

In FIG. 7, the shock absorbing pad 26 replaces the bumper toe plate 14A. In such an arrangement, in which the shock absorbing pad 26 is exposed, some consideration must be taken to select a material offering tear resistance and other properties characterizing exposed boot materials. For example, neoprene or butyl rubber could be well-suited to be used for the shock absorbing pad 26 in the embodiment of FIG. 7.

As in FIGS. 3, 4, 5 and 6, FIG. 7 shows a foremost point of the protective toe-cap illustrated at 27. The concave sole shell 14 of the sole 12 therefore extends above the foremost point 27 along vertical axis 28, and extends rearwardly of the foremost point 27 along horizontal axis 29, in forming its concavity.

In FIGS. 3 to 7, it is understood that the protective toe-cap may be removed or substituted by box toe material or a stiffener. For example, hiking boots may not require the use of a protective toe-cap. When the item of footwear 10 is without the toe-cap, the foremost point 27 is the foremost point of the inner surface of the foot receiving cavity of the item of footwear 10, whether the foremost point is part of the sole or of the upper.

The invention claimed is:

1. An item of footwear having a rear end and a front end, the item of footwear comprising:

an upper adapted to receive a foot of the wearer;

a sole forming a bottom surface of the item of footwear, the sole having an outsole and a midsole;

a toe-cap including a hard concave shell at the front end of the item of footwear;

a shock-absorbing pad between the concave shell and the front end of the item of footwear, the shock-absorbing pad being made of a material attenuating an impact force by at least 60% in a flat surface impact test, single drop of a 8.5 kg mass, at 1.0 m/s velocity; and a head plate secured at the front end of the item of footwear, forward of the shock-absorbing pad and exposed at an exterior surface of the item of footwear, the shock-absorbing pad being unexposed at the exterior surface of the item of footwear, the shock-absorbing pad concealed between the toe-cap and the head plate, wherein the outsole defines a concave outsole shell and the midsole defines a concave midsole shell, the concave outsole shell and the concave midsole shell extending upwardly from the sole, and forward of the concave shell of the toe cap.

2. The item of footwear according claim 1, to wherein each of the outsole and of the midsole is single-piece monolithic.

3. The item of footwear according to claim 1, wherein the toe-cap is sandwiched between two layers of the upper.

4. The item of footwear according to claim 1, wherein the material of the shock absorbing pad is selected from the group including at least one of ester polyurethane, ether polyurethane, foamed polyurethane, viscoelastic foam, polyurethane memory foam, polyethylene foam, blended EVA foam, molded silicone rubber, butyl rubber, fluoro rubber sponge, and urethane-based synthetic shock absorbing gel.

* * * * *